US012385485B2

(12) United States Patent
Park et al.

(10) Patent No.: US 12,385,485 B2
(45) Date of Patent: Aug. 12, 2025

(54) SCROLL COMPRESSOR

(71) Applicant: LG ELECTRONICS INC., Seoul (KR)

(72) Inventors: Honghee Park, Seoul (KR); Wooyoung Kim, Seoul (KR); Byeonghun Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/595,658

(22) Filed: Mar. 5, 2024

(65) Prior Publication Data

US 2024/0318654 A1 Sep. 26, 2024

(30) Foreign Application Priority Data

Mar. 21, 2023 (KR) ..... 10-2023-0036739

(51) Int. Cl.
*F04C 18/02* (2006.01)
*F04C 29/00* (2006.01)
(Continued)

(52) U.S. Cl.
CPC ..... *F04C 18/0215* (2013.01); *F04C 18/0246* (2013.01); *F04C 18/0261* (2013.01);
(Continued)

(58) Field of Classification Search
CPC ..... F04C 18/0261; F04C 18/0215; F04C 18/0253; F04C 18/0246; F04C 18/0269;
(Continued)

(56) References Cited

U.S. PATENT DOCUMENTS

2020/0158109 A1* 5/2020 Jo ..... F04C 29/0021

FOREIGN PATENT DOCUMENTS

CN 109306959 A * 2/2019 ..... F04C 18/0223
JP 2011-064189 3/2011
(Continued)

OTHER PUBLICATIONS

CN 109306959 by PE2E Jun. 27, 24.*
(Continued)

*Primary Examiner* — Deming Wan
(74) *Attorney, Agent, or Firm* — KED & ASSOCIATES

(57) ABSTRACT

A scroll compressor may include a back pressure passage that provides communication between a compression chamber and a back pressure chamber to guide refrigerant compressed in the compression chamber partially to the back pressure chamber. The back pressure passage may communicate with the compression chamber through a front end surface of a non-orbiting wrap axially facing an orbiting end plate. Accordingly, when an orbiting scroll tilts, the non-orbiting wrap may be spaced apart from the orbiting end plate to open a scroll back pressure hole, such that the compression chamber and the back pressure chamber communicate with each other to quickly vary pressure in the back pressure chamber to be adaptive to the pressure of the compression chamber. This may result in appropriately adjusting back pressure in the back pressure chamber according to an operating mode and/or operating conditions, thereby increasing a sealing power and suppressing or preventing excessive contact.

20 Claims, 9 Drawing Sheets

(51) Int. Cl.
*F04C 29/02* (2006.01)
*F04C 29/12* (2006.01)

(52) U.S. Cl.
CPC ..... *F04C 18/0269* (2013.01); *F04C 29/0035* (2013.01); *F04C 29/12* (2013.01); *F04C 2240/30* (2013.01)

(58) Field of Classification Search
CPC ... F04C 18/0292; F04C 29/0035; F04C 29/12
See application file for complete search history.

(56) References Cited

FOREIGN PATENT DOCUMENTS

| | | | |
|---|---|---|---|
| KR | 10-2004-0019631 | 3/2004 | |
| KR | 10-2011-0009257 | 1/2011 | |
| KR | 10-2021-0156094 | 12/2021 | |
| KR | 10-2022-0030346 | 3/2022 | |
| WO | WO-2022177176 A1 * | 8/2022 | ..... F04C 18/0215 |

OTHER PUBLICATIONS

English translation of WO2022177176 by PE2E Apr. 11, 2025.*
Korean Office Action issued in Application No. 10-2023-0036739 dated Jul. 19, 2024.

* cited by examiner

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2023-0036739, filed in Korea on Mar. 21, 2023, the contents of which are incorporated by reference herein in their entirety.

BACKGROUND

1. Field

A scroll compressor is disclosed herein.

2. Background

In a scroll compressor, a fixed scroll (or non-orbiting scroll) and an orbiting scroll that from a compression unit are engaged with each other to define a pair of compression chambers. This scroll compressor has fewer components and can rotate at a high speed because suction, compression, and discharge occur continuously while the orbiting scroll rotates. Additionally, as a torque required for compression is less varied and suction and compression occur continuously, noise and vibration are low. For this reason, scroll compressors are widely applied to air conditioners.

Recently, as the severity of climate change has been highlighted, variable capacity scroll compressors that can reduce carbon emissions have been developed. A variable capacity scroll compressor may vary a compression capacity depending on an operating mode of the compressor or an air conditioner, thereby improving energy efficiency by suppressing or preventing unnecessary energy loss.

The related art variable capacity scroll compressor is equipped with a separate control device inside of a casing to vary a compression capacity. Another variable capacity scroll compressor has a separate piping and a control device outside of a casing.

In these related art fixed back pressure type variable capacity scroll compressors, optimal position of a back pressure passage that provides communication between a compression chamber and a back pressure chamber differs depending on an operating mode of the compressor. In other words, it is advantageous for the back pressure passage in a saving mode to be located at a higher pressure side than the back pressure passage in a power mode because appropriate back pressure can be secured for each operating mode. However, if the back pressure passage is located at a different location in each operating mode, it is disadvantageous to maintain a constant back pressure in the back pressure chamber, so the position of the back pressure passage is usually set based on the saving mode.

However, in the related art fixed back pressure type variable capacity scroll compressor, as the back pressure passage penetrates an end plate portion of a non-orbiting scroll facing an orbiting wrap of an orbiting scroll, the back pressure passage is periodically opened and closed by the orbiting wrap during operation. Due to this, pressure in the back pressure chamber is not quickly adaptive to pressure in the compression chamber. As a result, in a power mode, the back pressure rises excessively and friction between the non-orbiting scroll and the orbiting scroll increases, causing reduction in efficiencies of the compressor and a refrigeration cycle having the compressor. This may equally occur even in a low-speed and low-pressure ratio operation in which a compression ratio is less than 1.5.

BRIEF DESCRIPTION OF THE DRAWINGS

Embodiments will be described in detail with reference to the following drawings in which like reference numerals refer to like elements, and wherein.

DETAILED DESCRIPTION

Figure 1:
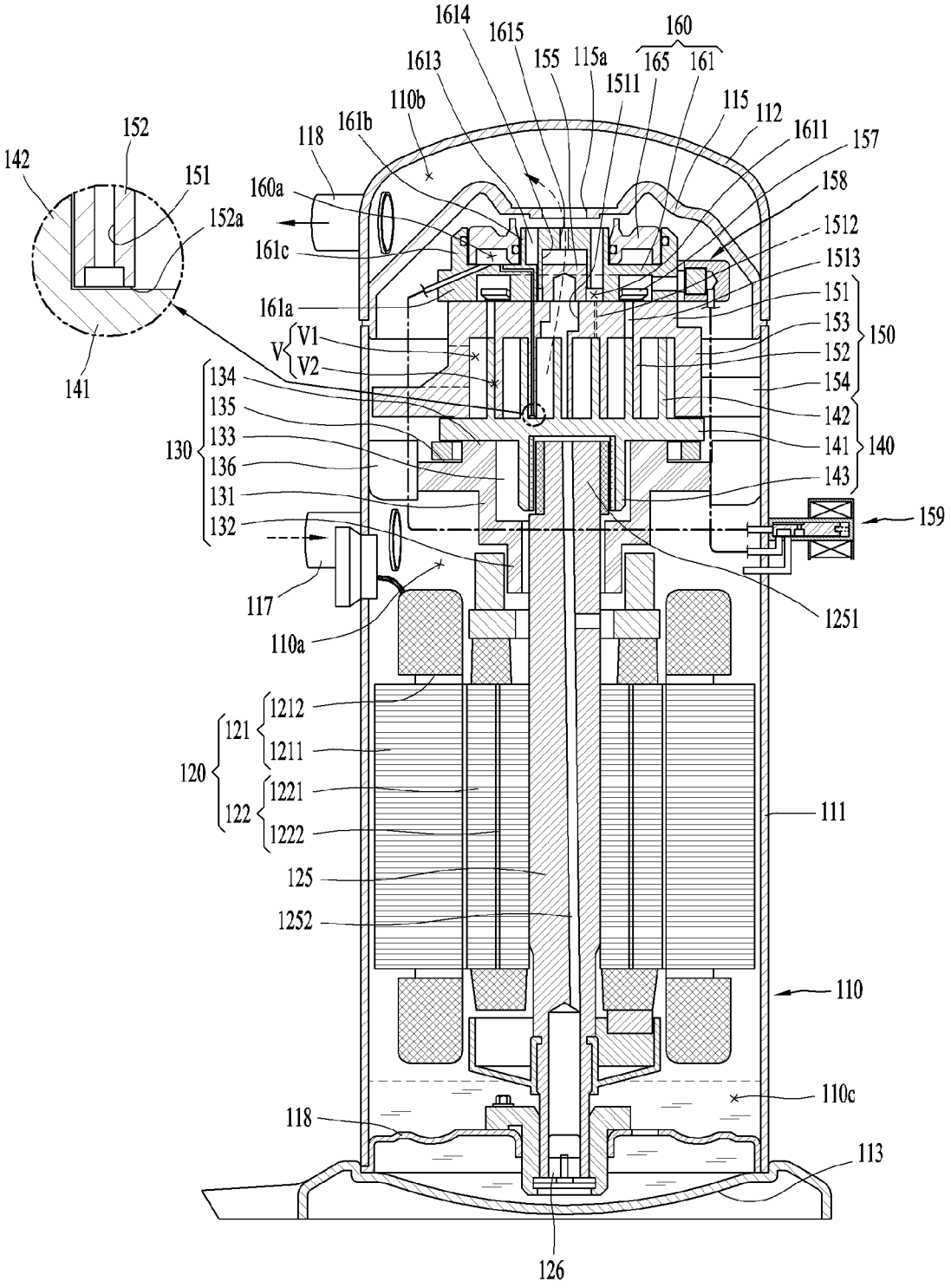
FIG. 1 is a longitudinal cross-sectional view of a scroll compressor having a variable capacity device in accordance with an embodiment.

Description will now be given of a scroll compressor according to exemplary embodiments disclosed herein, with reference to the accompanying drawings. Wherever possible, the same or like reference numerals have been used to indicate the same or like components, and repetitive disclosure has been omitted.

Typically, a scroll compressor may be classified as an open type or a hermetic type depending on whether a drive unit (motor unit) and a compression unit are all installed in an inner space of a casing. The former is a compressor in which the motor unit configuring the drive unit is provided separately from the compression unit, and the latter hermetic type is a compressor in which both the motor unit and the compression unit are disposed inside of the casing. Hereinafter, a hermetic type scroll compressor will be described as an example; however, embodiments are not necessarily limited to the hermetic scroll compressor. In other words, the embodiments may be equally applied to the open type scroll compressor in which the motor unit and the compression unit are disposed separately from each other.

In addition, scroll compressors may be classified into a vertical scroll compressor in which a rotational shaft is disposed perpendicular to the ground and a horizontal (lateral) scroll compressor in which the rotational shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, the embodiments may be equally applied to the horizontal scroll compressor. Hereinafter, it will be understood that an axial direction is an axial direction of the rotational shaft, a radial direction is a radial direction of the rotational shaft, the axial direction is an upward and downward (or vertical) direction, and the radial direction is a leftward and rightward or lateral direction, respectively.

FIG. 1 is a longitudinal cross-sectional view of a scroll compressor having a capacity varying device in accordance with an embodiment. Referring to FIG. 1, a scroll compressor according to an embodiment may include a drive motor 120 disposed in a lower half portion of a casing 110, and a main frame 130, an orbiting scroll 140, a non-orbiting scroll 150, and a back pressure chamber assembly 160 that form a compression unit disposed above the drive motor 120. The motor unit is coupled to one or a first end of a rotational shaft 125, and the compression unit is coupled to another or a second end of the rotational shaft 125. Accordingly, the compression unit may be connected to the motor unit by the rotational shaft 125 to be operated by a rotational force of the motor unit.

The casing 110 may include a cylindrical shell 111, an upper cap 112, and a lower cap 113. The cylindrical shell 111 has a cylindrical shape with upper and lower open ends, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 described hereinafter is coupled to the upper portion of the cylindrical shell 111, for example, above the drive motor 120.

The upper cap 112 may be coupled to cover the open upper end of the cylindrical shell 111. The lower cap 113 may be coupled to cover the lower open end of the cylindrical shell 111. A rim of a high/low pressure separation plate 115 described hereinafter may be inserted between the cylindrical shell 111 and the upper cap 112 to be, for example, welded on the cylindrical shell 111 and the upper cap 112. A rim of a support bracket 116 described hereinafter may be inserted between the cylindrical shell 111 and the lower cap 113 to be, for example, welded on the cylindrical shell 111 and the lower cap 113. Accordingly, the inner space of the casing 110 may be sealed.

The rim of the high/low pressure separation plate 115 may be welded on the casing 110 as described above. A central portion of the high/low pressure separation plate 115 may be bent and protrude toward an upper surface of the upper cap 112 so as to be disposed above the back pressure chamber assembly 160 described hereinafter. The refrigerant suction pipe 117 may communicate with a space below the high/low pressure separation plate 115, and a refrigerant discharge pipe 118 may communicate with a space above the high/low pressure separation plate 115. Accordingly, a low-pressure part or portion 110*a* forming a suction space may be formed below the high/low pressure separation plate 115, and a high-pressure part or portion 110*b* forming a discharge space may be formed above the high/low pressure separation plate 115.

In addition, a through hole 115*a* may be formed through a center of the high/low pressure separation plate 115. The low-pressure portion 110*a* and the high-pressure portion 110*b* may be blocked from each other by attachment/detachment of a floating plate 165 and the high/low pressure separation plate 115 or may communicate with each other through a through hole 115*a* of the high/low pressure separation plate 115.

In addition, the lower cap 113 may define an oil storage space 110*c* together with the lower portion of the cylindrical shell 111 forming the low-pressure portion 110*a*. In other words, the oil storage space 110*c* may be defined in the lower portion of the low-pressure portion 110*a*. The oil storage space 110*c* thus defines a portion of the low-pressure portion 110*a*.

Referring to FIG. 1, the drive motor 120 according to this embodiment is disposed in a lower half portion of the low-pressure portion 110*a* and includes a stator 121 and a rotor 122. The stator 121 may be, for example, shrink-fitted to an inner wall surface of the cylindrical shell 111, and the rotor 122 may be rotatably disposed inside of the stator 121.

The stator 121 may include a stator core 1211 and a stator coil 1212. The stator core 1211 may be formed in a cylindrical shape and may be, for example, shrink-fitted onto an inner circumferential surface of the cylindrical shell 111. The stator coil 1212 may be wound around the stator core 1211 and may be electrically connected to an external power source through a terminal (not illustrated) that is coupled through the casing 110.

The rotor 122 may include a rotor core 1221 and permanent magnets 1222. The rotor core 1221 may be formed in a cylindrical shape, and rotatably inserted into the stator core 1211 with a preset or predetermined gap therebetween. The permanent magnets 1222 may be embedded in the rotor core 1222 at preset or predetermined intervals along a circumferential direction.

In addition, the rotational shaft 125 may be, for example, press-fitted to a center of the rotor core 1221. An orbiting scroll 140 described hereinafter may be eccentrically coupled to an upper end of the rotational shaft 125. Accordingly, a rotational force of the drive motor 120 may be transmitted to the orbiting scroll 140 through the rotational shaft 125.

An eccentric portion 1251 that is eccentrically coupled to the orbiting scroll 140 described hereinafter may be formed on an upper end of the rotational shaft 125. An oil pickup 126 that suctions up oil stored in the lower portion of the casing 110 may be disposed at a lower end of the rotational shaft 125. An oil passage 1252 may be formed through an inside of the rotational shaft 125 in the axial direction.

Referring to FIG. 1, the main frame 130 is disposed on an upper side of the drive motor 120, and may be, for example, shrink-fitted to or welded on an inner wall surface of the cylindrical shell 111. The main frame 130 may include a main flange portion 131, a main bearing portion 132, an orbiting space portion 133, a scroll support portion 134, an Oldham ring support portion 135, and a frame fixing portion 136.

The main flange portion 131 may be formed in an annular shape and accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 described hereinafter may protrude from an outer circumferential surface of the main flange portion 131 in the radial direction. The outer circumferential surface of the frame fixing portion 136 may be fixed in close contact with the inner circumferential surface of the casing 110. Accordingly, the frame 130 may be fixedly coupled to the casing 110.

The main bearing portion 132 may protrude downward from a lower surface of a central portion of the main flange portion 131 toward the drive motor 120. A bearing hole 132*a* formed in a cylindrical shape may penetrate through the main bearing portion 132 in the axial direction. Accordingly, the rotational shaft 125 may be inserted into an inner circumferential surface of the bearing hole 132*a* and supported in the radial direction.

The orbiting space portion 133 may be recessed from a center part or portion of the main flange portion 131 toward the main bearing portion 132 to have a predetermined depth and outer diameter. The outer diameter of the orbiting space portion 133 may be larger than an outer diameter of a rotational shaft coupling portion 143 that is disposed on the orbiting scroll 140 described hereinafter. Accordingly, the rotational shaft coupling portion 143 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support a lower surface of an orbiting end plate 141 described hereinafter in the axial direction.

The Oldham ring support portion 135 may be formed in an annular shape on an upper surface of the main flange portion 131 along an outer circumferential surface of the scroll support portion 134. Accordingly, an Oldham ring 170 may be inserted into the Oldham ring supporting portion 135 to be pivotable.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 has a plurality of protrusions along the circumferential direction.

Referring to FIG. 1, the orbiting scroll 140 according to this embodiment is coupled to the rotational shaft 125 to be disposed between the main frame 130 and the non-orbiting scroll 150. The Oldham ring 170, which is an anti-rotation mechanism, is disposed between the main frame 130 and the orbiting scroll 140. Accordingly, the orbiting scroll 140 performs an orbiting motion relative to the non-orbiting scroll 150 while its rotational motion is restricted.

The orbiting scroll 140 may include an orbiting end plate 141, orbiting wrap 142, and rotational shaft coupling portion 143. The orbiting end plate 141 may be formed approximately in a disk shape. The outer diameter of the orbiting end plate 141 may be mounted on the scroll support portion 134 of the main frame 130 to be supported in the axial direction. Accordingly, the orbiting end plate 141 and the scroll support portion 134 facing it define an axial bearing surface (no reference numeral given).

The orbiting wrap 142 may be formed in a spiral shape by protruding from an upper surface of the orbiting end plate 141 facing the non-orbiting scroll 150 to a preset or predetermined height. The orbiting wrap 142 is formed to correspond to a non-orbiting wrap 152 to perform an orbiting motion by being engaged with the non-orbiting wrap 152 of the non-orbiting scroll 150 described hereinafter. The orbiting wrap 142 defines compression chambers V together with the non-orbiting wrap 152.

The compression chambers V include first compression chamber V1 and second compression chamber V2 based on the orbiting wrap 142. Each of the first compression chamber V1 and the second compression chamber V2 includes a suction pressure chamber (not illustrated), an intermediate pressure chamber (not illustrated), and a discharge pressure chamber (not illustrated) that are continuously formed. Hereinafter, description will be given under the assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

The rotational shaft coupling portion 143 may protrude from the lower surface of the orbiting end plate 141 toward the main frame 130. The rotational shaft coupling portion 143 may be formed, for example, in a cylindrical shape, so that an orbiting bearing (not illustrated) configured as a bush bearing may be press-fitted to its inner circumferential surface.

Referring to FIG. 1, the non-orbiting scroll 150 according to this embodiment may be disposed on an upper portion of the main frame 130 with the orbiting scroll 140 interposed therebetween. The non-orbiting scroll 150 may be fixedly coupled to the main frame 130 or may be coupled to the main frame 130 to be movable up and down. This embodiment illustrates an example in which the non-orbiting scroll 150 is coupled to the main frame 130 to be movable relative to the main frame 130 in the axial direction.

More specifically, the non-orbiting scroll 150 according to this embodiment may include a non-orbiting end plate 151, non-orbiting wrap 152, a non-orbiting side wall portion 153, and a guide protrusion 154. The non-orbiting end plate 151 may be, for example, formed in a disk shape and disposed in a horizontal (lateral) direction in the low-pressure portion 110*a* of the casing 110. A discharge port 1511, a bypass hole(s) 1512, a variable capacity hole(s) 1513, and a scroll back pressure hole 181 may be formed in the non-rotating end plate portion 151. The discharge port 1511, bypass hole 1512, and variable capacity hole 1513 may each be formed to penetrate the non-orbiting end plate portion 151, while the scroll back pressure hole 181 may be formed to penetrate a front end surface 152*a* of the non-orbiting wrap 152. In other words, the discharge port 1511, the bypass hole 1512, and the variable capacity hole(s) 1513 may each be formed such that both ends penetrate both side surfaces of the non-orbiting end plate portion 151. On the other hand, the scroll back pressure hole 181 may be formed such that a first end 181*a* penetrates the front end surface 152*a* of the non-orbiting wrap 152 and a second end 181*b* penetrates the rear surface of the non-orbiting end plate portion 151.

The discharge port 1511 is a passage through which compressed refrigerant is discharged from a final compression chamber (for example, discharge pressure chamber) V to the high-pressure portion 110*b*. The discharge port 1511 may be provided as one discharge port through which discharge pressure chambers (no reference numeral) of both compression chambers V1 and V2 formed at inner and outer sides of the non-orbiting wrap 152 communicate with each other. However, in some cases, the discharge port 1511 may be provided as a plurality to communicate with the compression chambers V1 and V2 independently. This embodiment illustrates an example in which one discharge port 1511 is provided.

The bypass hole 1512 is a type of overcompression suppressing portion that is formed at a suction side, compared to the discharge port 1511, such that some of compressed refrigerant is discharged to the high-pressure portion 110*b* in advance. The bypass hole(s) 1512 may be formed to communicate with each compression chamber V1, V2 independently. The bypass hole(s) 1512 may be formed in each of the respective compression chambers V1 and V2. However, in some cases, the bypass holes 1512 may be provided as a plurality in each compression chamber V1, V2 spaced apart at a preset or predetermined distances along a formation direction (or rotational direction or circumferential direction of the scrolls 140, 150) of the compression chamber V1, V2.

The variable capacity hole(s) 1513 may be formed at a position spaced apart from the discharge port 1511 and the bypass holes 1512, respectively. In other words, the variable capacity hole(s) 1513 may connect each compression chamber V1, V2 and the low-pressure portion 110*a*, and thus, may be located at a suction side compared to the bypass hole 1512.

The non-orbiting wrap 152 may extend from a lower surface of the non-orbiting end plate portion 151 facing the orbiting scroll 140 by a preset or predetermined height in the axial direction. The non-orbiting wrap 142 may extend to be spirally rolled a plurality of times toward the non-orbiting side wall portion 153 in the vicinity of the discharge port 1511. The non-orbiting wrap 152 may be formed to correspond to the orbiting wrap 142, so as to define a pair of compression chambers V with the orbiting wrap 142.

The front end surface 152*a* which faces the orbiting end plate portion 141 may be formed flat overall on the non-orbiting wrap 152, but the second end 181*a* of the scroll back pressure hole 181 described above may penetrate a preset or predetermined portion of the non-orbiting wrap 152. Accordingly, the scroll back pressure hole 181 may be formed to penetrate between the rear surface 151*a* of the non-orbiting end plate portion 151 and the front end surface 152*a* of the non-orbiting wrap 152. The scroll back pressure hole 181 will be described hereinafter together with a plate back pressure hole 182.

The non-orbiting side wall portion 153 may extend in an annular shape from a rim of the lower surface of the non-orbiting end plate 151 in the axial direction to surround the non-orbiting wrap 152. A suction port 1531 may be formed through one side of an outer circumferential surface of the non-orbiting side wall portion 153 in the radial direction.

The guide protrusion 154 may extend radially from an outer circumferential surface of a lower side of the non-orbiting side wall portion 153. The guide protrusion 154 may be formed in a single annular shape or may be provided as a plurality disposed at preset or predetermined distances in the circumferential direction. This embodiment will be mainly described based on an example in which a plurality of guide protrusions 154 is disposed at preset or predetermined distances along the circumferential direction.

Referring to FIG. 1, the back pressure chamber assembly 160 according to this embodiment is disposed at an upper side of the non-orbiting scroll 150. Accordingly, back pressure of a back pressure chamber 160*a* (more specifically, a force of the back pressure which acts on the back pressure chamber) is applied to the non-orbiting scroll 150. In other words, the non-orbiting scroll 150 is pressed toward the orbiting scroll 140 by the back pressure to seal the compression chambers V1 and V2.

The back pressure chamber assembly 160 may include a back pressure plate 161 and a floating plate 165. The back pressure plate 161 may be coupled to an upper surface of the non-orbiting end plate 151 and the floating plate 165 may be slidably coupled to the back pressure plate 161 to define a back pressure chamber 160*a* together with the back pressure plate 161.

The back pressure plate 161 may include a fixed plate portion 161*a*, a first annular wall portion 161*b*, and a second annular wall portion 161*c*. The fixed plate portion 161*a* is a portion coupled to the rear surface of the non-orbiting end plate portion 151, and the first annular wall portion 161*b* and the second annular wall portion 161*c* extend from the upper surface of the fixed plate portion 161*a*. Accordingly, the back pressure chamber 160*a* formed in the annular shape is defined by an upper surface of the fixed plate portion 161*a*, an outer circumferential surface of the first annular wall portion 161*a*, an inner circumferential surface of the second annular wall portion 161*b*, and a lower surface of the floating plate 165.

The fixed plate portion 161*a* may be formed in the annular shape so that an intermediate discharge space portion 1611 is defined in or at its central portion. A back pressure passage protrusion 1612 described hereinafter may protrude from an inner circumferential surface of the intermediate discharge space portion 1611 and extend in the axial direction, and a plate back pressure hole 182 that communicates with the back pressure chamber 160*a* may be formed through an inside of the back pressure passage protrusion 1612 in the axial direction. Accordingly, the plate back pressure hole 182 may be formed at a position at which it overlaps an intermediate discharge port 1613 described hereinafter when projected in the axial direction.

The plate back pressure hole 182 may communicate with the scroll back pressure hole 181 disposed in the non-orbiting scroll 150. In other words, a first end 182*a* of the plate back pressure hole 182 may communicate with the second end 181*b* of the scroll back pressure hole 181, which will be described hereinafter, and a second end 182*b* of the plate back pressure hole 182 may communicate with the back pressure chamber 160*a*. Accordingly, the compression chamber V and the back pressure chamber 160*a* may communicate with each other through the scroll back pressure hole 181 and the plate back pressure hole 182.

The plate back pressure hole 182 may be formed on a same axis in the axial direction as the scroll back pressure hole 181, may be formed on different axial lines, or may be formed at an angle with respect to the axial direction. This embodiment illustrates an example in which a portion of the plate back pressure hole 182 communicates with the scroll back pressure hole 181 on the same axis in the axial direction. This may minimize an overall length of the plate back pressure hole 182, thereby reducing a dead volume due to the plate back pressure hole 182. The plate back pressure hole 182 will be described hereinafter together with the scroll back pressure hole 181.

The first annular wall portion 161*a* has an intermediate discharge port 1613 that communicates with the discharge port 1511 of the non-orbiting scroll 150. A valve guide groove 1614 into which a discharge valve 155 may be slidably inserted may be formed inside of the intermediate discharge port 1613. A backflow prevention hole 1615 may be formed in or at a center of the valve guide groove 1614. Accordingly, the discharge valve 155 may be selectively opened and closed between the discharge port 1511 and the intermediate discharge port 1613 to suppress or prevent discharged refrigerant from flowing back into the compression chamber V1, V2.

The floating plate 165 may be formed in an annular shape. The floating plate 165 may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on a pressure of the back pressure chamber 160*a*. For example, when the floating plate 165 is brought into contact with the high/low pressure separation plate 115, the floating plate 165 serves to seal the low-pressure portion

110*a* such that the discharged refrigerant flows to the high-pressure portion 110*b* without leaking into the low-pressure portion 110*a*.

In the drawings, reference numeral 156 denotes a bypass valve, 157 denotes a variable capacity valve, 158 denotes a capacity opening and closing valve, 159 denotes a capacity control valve, and 180 denotes a back pressure passage.

The scroll compressor according to an embodiment may operate as follows.

That is, when power is applied to the drive motor 120 and a rotational force is generated, the orbiting scroll 140 eccentrically coupled to the rotational shaft 125 performs an orbiting motion relative to the non-orbiting scroll 150 due to the Oldham ring 170. During this process, first compression chamber V1 and second compression chamber V2 that continuously move are formed between the orbiting scroll 140 and the non-orbiting scroll 150. The first compression chamber V1 and the second compression chamber V2 are gradually reduced in volume as they move from suction port 1531 (or suction pressure chamber) to discharge port 1511 (or discharge pressure chamber) during the orbiting motion of the orbiting scroll 140.

Accordingly, refrigerant is suctioned into the low-pressure portion 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

The refrigerant is compressed while moving along moving paths of the first compression chamber V1 and the second compression chamber V2. The compressed refrigerant partially flows into the back pressure chamber 160*a* formed by the back pressure plate 161 and the floating plate 165 through the scroll back pressure hole 181 forming an inlet-side back pressure passage and the plate back pressure hole 182 forming an outlet-side back pressure passage before reaching the discharge port 1511. Accordingly, the back pressure chamber 160*a* forms an intermediate pressure.

The floating plate 165 rises toward the high/low pressure separation plate 115 to be brought into close contact with the high/low pressure separation plate 115. Then, the high-pressure portion 110*b* of the casing 110 is separated from the low-pressure portion 110*a*, to prevent the refrigerant discharged from each compression chamber V1 and V2 from flowing back into the low-pressure portion 110*a*.

On the other hand, the back pressure plate 161 is pressed down toward the non-orbiting scroll 150 by pressure of the back pressure chamber 160*a*. Then, the non-orbiting scroll 150 is pressed toward the orbiting scroll 140. Accordingly, the non-orbiting scroll 150 may be brought into close contact with the orbiting scroll 140, thereby preventing the refrigerant inside of the compression chambers V1 and V2 from leaking from a high-pressure compression chamber forming an intermediate pressure chamber to a low-pressure compression chamber.

The refrigerant is compressed up to a set pressure while moving from the intermediate pressure chamber toward the discharge pressure chamber. This refrigerant moves to the discharge port 1511 and presses the discharge valve 155 in an opening direction. Responsive to this, the discharge valve 155 is pushed up along the valve guide groove 1612*b* by the pressure of the discharge pressure chamber, so as to open the discharge port 1511. The refrigerant in the discharge pressure chamber flows to the high-pressure portion 110*b* through the discharge port 1511 disposed in the non-orbiting end plate portion 151 and the intermediate discharge port 1613 disposed in the back pressure plate 161.

In the scroll compressor according to this embodiment, a variable capacity unit that communicates with an intermediate pressure chamber is provided. The compressor operates in a power mode (power operation) when the variable capacity unit is in a high-pressure side open state while operating in a saving mode (saving operation) when the variable capacity unit is in a low-pressure side open state. Accordingly, energy efficiency may be increased by varying a compression capacity while the compressor operates at a constant speed.

For example, during the power operation, refrigerant in the back pressure chamber 160*a* forming a high pressure (intermediate pressure) is supplied to the capacity opening and closing valve constituting a portion of the variable capacity unit, such that the capacity opening and closing valve closes the variable capacity hole 1513. The refrigerant suctioned into the compression chamber V is compressed while continuously moving up to the discharge pressure chamber without being bypassed in the intermediate pressure chamber. Accordingly, the compressor performs the power operation which is performed using 100% of the capacity of the compressor.

On the other hand, during the saving operation, the capacity opening and closing valve communicates with the low-pressure portion (suction space) 110*a* of the casing 110, and the variable capacity valve 1812 opens the variable capacity hole 1513. A portion of the refrigerant suctioned into the compression chamber V is bypassed to the low-pressure portion 110*a* of the casing 110 through the variable capacity hole 1811*a*. Accordingly, the compressor performs the saving operation which is performed using approximately 60 to 70% of the capacity of the compressor.

At this time, when the position of the back pressure passage 180 that provides communication between the compression chamber V1, V2 forming the intermediate pressure chamber and the back pressure chamber 160*a* is set based on the power operation, leakage between compression chambers V may occur in the saving operation generally used in the compressor and/or refrigeration cycle. On the other hand, when the position is set based on the saving operation, friction loss may occur due to excessive contact between scrolls 140 and 150 in the power operation.

Accordingly, in this embodiment, the position of the back pressure passage 180 may be set based on the saving operation, and the back pressure passage 180 may be opened and closed to be adaptive to a pressure difference between the compression chamber V and the back pressure chamber 160*a*. This may suppress or prevent not only leakage between the compression chambers in the saving operation but also excessive contact between the scrolls in the power operation.

Figure 2:
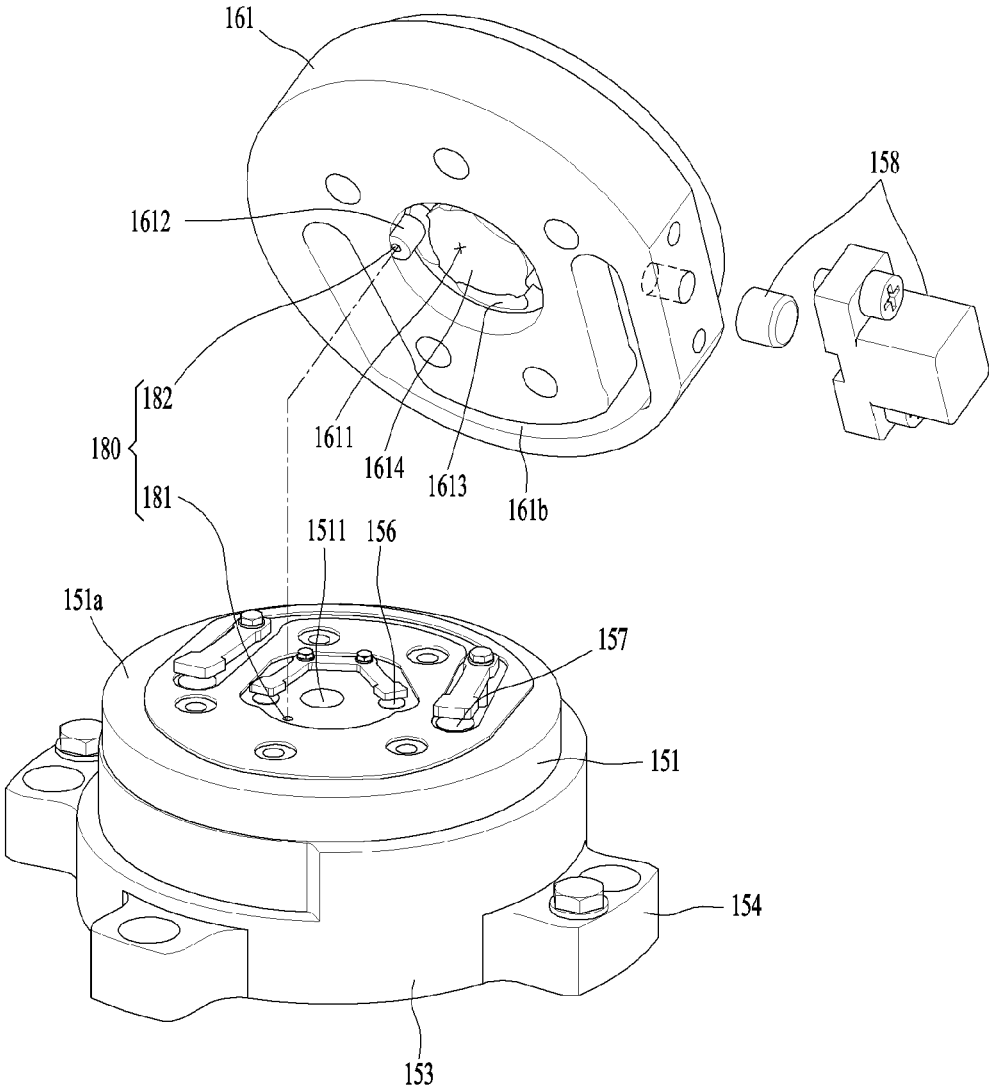
FIG. 2 is an exploded perspective view of one embodiment of a compression unit in the scroll compressor according to FIG. 1 according to an embodiment.
Figure 3:
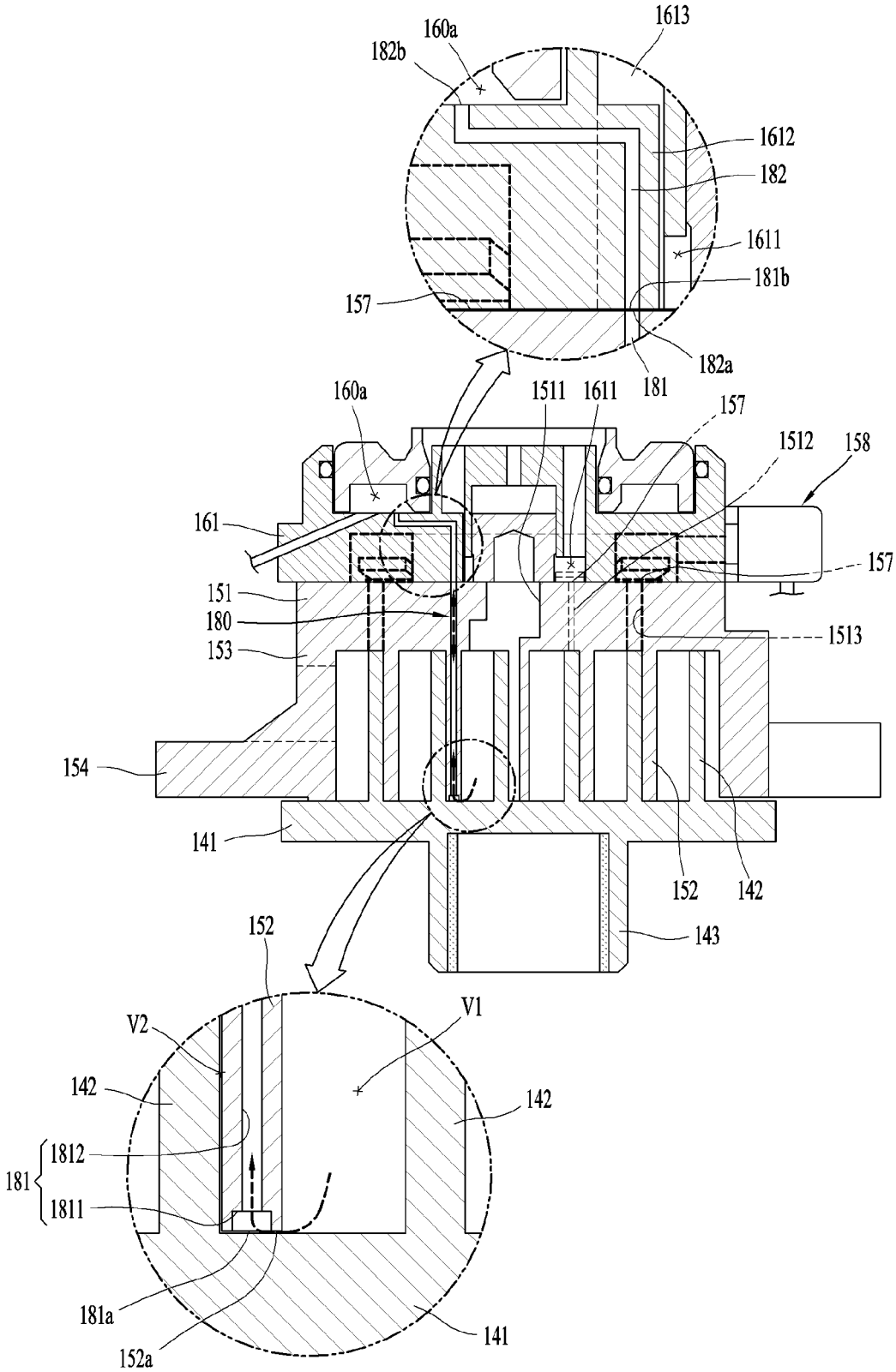
FIG. 3 is an assembled cross-sectional view of the compression unit of FIG. 2.
Figure 4:
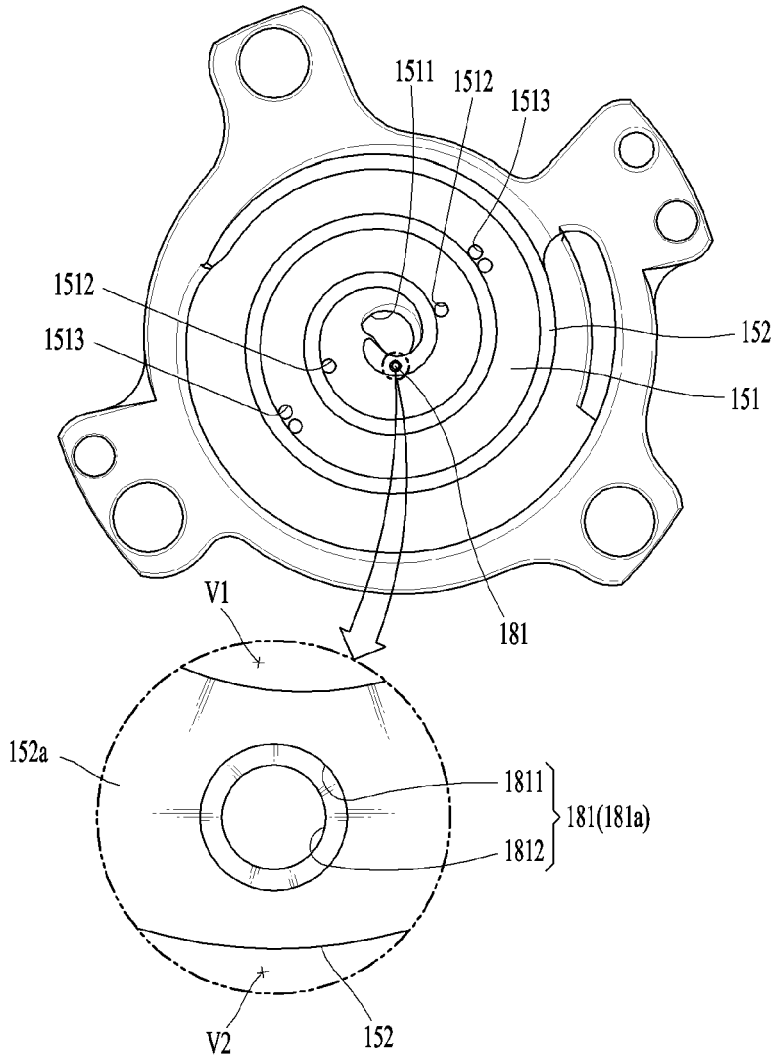
FIG. 4 is a bottom view of a non-orbiting scroll for explaining a back pressure passage in FIG. 1.
Figure 5:
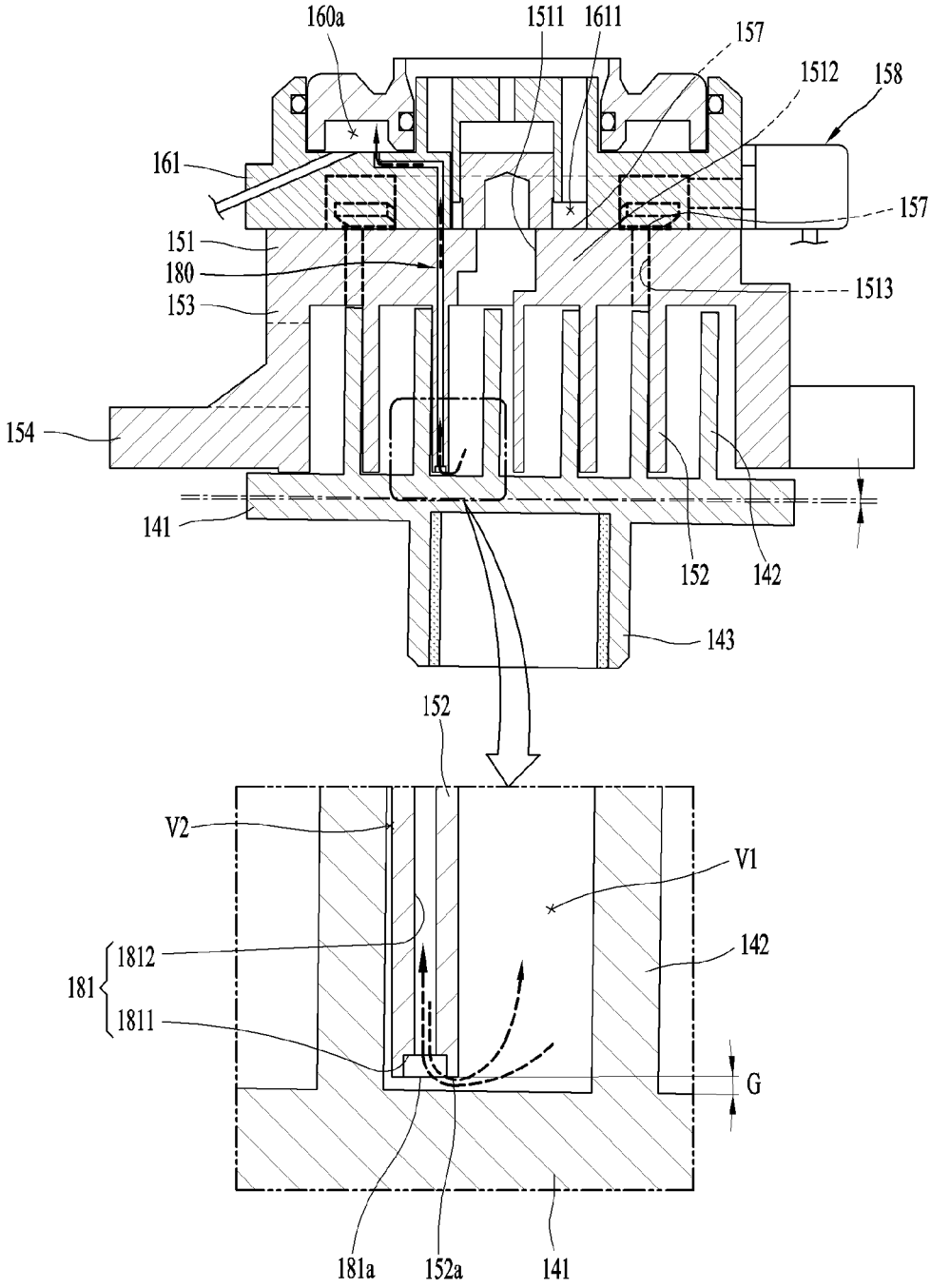
FIG. 5 is a cross-sectional view illustrating a state in which the back pressure passage is open in the scroll compressor according to FIG. 1.

FIG. 2 is an exploded perspective view of a compression unit in the scroll compressor according to FIG. 1 according to an embodiment. FIG. 3 is an assembled cross-sectional view of the compression unit of FIG. 2. FIG. 4 is a bottom view of a non-orbiting scroll for explaining a back pressure passage in FIG. 1, and FIG. 5 is a cross-sectional view illustrating a state in which the back pressure passage is open in the scroll compressor according to FIG. 1.

Referring to FIGS. 2 to 5, in the scroll compressor according to this embodiment, back pressure passage 180 may be formed in the non-orbiting scroll 150 and the back pressure plate 161 to provide communication between the compression chamber V and the back pressure chamber 160*a* such that a portion of the refrigerant compressed in the compression chamber V is guided to the back pressure chamber 180. The back pressure passage 180 may communicate with the compression chamber V through the front end surface 152*a* of the non-orbiting wrap 152 facing the orbiting end plate portion 141 in the axial direction. Accordingly, when wobbling of the orbiting scroll 140 occurs, the back pressure passage 180 may be open such that refrigerant flows in and out between the compression chamber V and the back pressure chamber 160*a*, thereby securing an appropriate back pressure.

For example, the back pressure passage 180 according to this embodiment may be formed to be located within a range of 360° along the formation direction of the non-orbiting wrap 152, starting from a discharge end of the non-orbiting wrap 152, which forms an inner end of the non-orbiting wrap 152. In other words, the scroll back pressure hole 181, which forms a portion of the back pressure passage 180, may be formed through the front end surface 152*a* of the non-orbiting wrap 152 facing the orbiting end plate portion 141, and may be located at a position as close to the discharge port 1511 as possible, for example, between the discharge port 1511 and the bypass hole 1512. Accordingly, a pressure difference between both ends of the back pressure passage 180 may be generated as large as possible, and thus, refrigerant may smoothly move between the compression chamber V and the back pressure chamber 160*a*.

The back pressure passage 180 may include scroll back pressure hole 181 and plate back pressure hole 182. As described above, the scroll back pressure hole 181 may be formed to communicate with the compression chamber V at the position corresponding to the discharge pressure chamber, and the plate back pressure hole 182 may be formed such that the scroll back pressure hole 181 communicates with the back pressure chamber 160*a*. Referring to FIGS. 2 and 3, the scroll back pressure hole 181 according to this embodiment may be formed to penetrate from the front end surface 152*a* of the non-orbiting wrap 152 to the rear surface 151*a* of the non-orbiting end plate portion (or non-orbiting scroll) 150. In other words, the first end 181*a* of the scroll back pressure hole 181 forming an inlet of the back pressure passage 180 may be formed through a central portion of the front end surface 152*a* of the non-orbiting wrap 1152. Accordingly, when the front end surface 152*a* of the non-orbiting wrap 152 is in contact with the orbiting end plate portion 141, the back pressure passage 180 may be blocked from the compression chamber V so as to block the compression chamber V and the back pressure chamber 160*a* from each other. On the other hand, when the front end surface 152*a* of the non-orbiting wrap 152 is spaced apart from the orbiting end plate portion 141, the back pressure passage 180 may communicate with the compression chamber V such that the communication chamber V communicates with the back pressure chamber 160*a*. With this structure, the back pressure passage 180 may be consecutively opened depending on a pressure of the compression chamber V and a pressure of the back pressure chamber 160*a*, and thus, the back pressure passage 180 may be formed based on the saving operation while suppressing or preventing excessive contact between scrolls in the power operation.

In other words, as in the related art, when the first end 181*a* of the scroll back pressure hole 181 is formed through the non-orbiting end plate portion 151 facing the front end surface of the orbiting wrap 142, the scroll back pressure hole 181 may be periodically opened and closed by the orbiting wrap 142, which may delay the pressure change in the back pressure chamber 160*a* according to the pressure of the compression chamber V. However, in this embodiment, as the first end 181*a* of the scroll back pressure hole 181 is formed through the front end surface 152*a* of the non-orbiting wrap 152, when the orbiting scroll 140 is tilted as illustrated in FIG. 5, the front end surface 152*a* of the non-orbiting wrap 152 of the non-orbiting scroll 150 is spaced apart from the orbiting end plate portion 141 facing it by a preset or predetermined distance G, thereby opening the scroll back pressure hole 181. The compression chamber V and the back pressure chamber 160*a* may communicate with each other, and the pressure of the back pressure chamber 160*a* may be quickly varied in response to the pressure of the compression chamber V. The pressure of the back pressure chamber 160*a*, that is, back pressure, may be appropriately adjusted according to an operating mode and/or operating conditions, thereby increasing a sealing power and suppressing or preventing excessive contact between the both scrolls 140 and 150.

Additionally, in this embodiment, the first end 181*a* of the scroll back pressure hole 181 may penetrate the front end surface 152*a* of the non-orbiting wrap 152 at a position close to the discharge port 1511. Accordingly, as described above, a large pressure difference may be generated between the compression chamber V and the back pressure chamber 160*a* through the back pressure passage 180, so as to suppress or prevent excessive contact between the scrolls in the power operation more effectively while the back pressure passage 180 is formed based on the saving operation.

Additionally, the scroll back pressure hole 181 may be formed on the same axis as the rotational shaft 125 or a portion of the scroll back pressure hole 181 may be tilted. This embodiment illustrates an example in which the scroll back pressure hole 181 is formed on the same axis as the rotational shaft.

In other words, the first end 181*a* of the scroll back pressure hole 181 according to this embodiment may penetrate the front end surface 152*a* of the non-orbiting wrap 152 at the position close to the discharge port 1511, and the second end 181*b* of the scroll back pressure hole 181 may penetrate from a more inward position than the back pressure chamber 160*a* to the rear surface of the non-orbiting scroll 150 (or non-orbiting end plate portion). Accordingly, the scroll back pressure hole 181 may be formed on the same axis as the rotational shaft 125, making it easy to form the scroll back pressure hole 181 and minimizing a length of the scroll back pressure hole 181 to thus reduce dead volume due to the scroll back pressure hole 181.

Also, the scroll back pressure hole 181 may be formed to have a same cross-sectional area or different cross-sectional areas along the axial direction. In other words, the first end 181*a* and the second end 181*b* of the scroll back pressure hole 181 may be formed with the same cross-sectional area, while the first end 181*a* and the second end 181*b* of the scroll back pressure hole 181 may be formed with different cross-sectional areas. This embodiment illustrates an example in which the first end 181*a* is formed wider than the second end 181*b*.

For example, as illustrated in FIG. 3, the scroll back pressure hole 181 may include a first back pressure passage portion 1811 that forms the first end 181*a* of the scroll back pressure hole 181, and a second back pressure passage portion 1812 that forms the second end 181*b* of the scroll back pressure hole 181. The first back pressure passage portion 1811 may be recessed by a preset or predetermined depth in the front end surface 152*a* of the non-orbiting wrap 152, and the second back pressure passage portion 1812 may communicate with the first back pressure passage portion 1811 and extend toward the back pressure plate 161.

In this case, the cross-sectional area of the first back pressure passage portion 1811 may be larger than the cross-sectional area of the second back pressure passage portion 1812. For example, the first back pressure passage portion 1811 and the second back pressure passage portion 1812 are each formed in a circular shape, and an inner diameter D1 of the first back pressure passage 1811 may be larger than an inner diameter D2 of the second back pressure passage portion 1812. Accordingly, a volume of the first back pressure passage portion 1811 adjacent to the compression chamber V may increase, forming a type of differential pressure space between the compression chamber V and the back pressure chamber 160*a*, thereby promoting refrigerant movement.

Also, in this case, the first back pressure passage portion 1811 and the second back pressure passage portion 1812 may be formed on the same axis. This may facilitate formation of the first back pressure passage portion 1811 and the second back pressure passage portion 1812.

However, in this case, as the first back pressure passage portion 1811 is formed close to the discharge port 1511, the second back pressure passage portion 1812 may be located more inward than the back pressure chamber 160*a*. Accordingly, the back pressure plate 161 may have a back pressure passage protrusion 1612, which will be described hereinafter, and thus, the plate back pressure hole 182 may be inclined or the second back pressure passage portion 1812 of the scroll back pressure hole 181 may be bent such that the second end 181*a* communicates with the back pressure chamber 160*a*. In this embodiment, an example in which the back pressure plate 161 has the back pressure passage protrusion 1612, which will be described hereinafter, is illustrated.

Referring to FIGS. 2 and 3, the plate back pressure hole 182 according to this embodiment may be formed through the back pressure plate 161, and the first end 182*a* of the plate back pressure hole 182 may communicate with the second end 181*a* of the scroll back pressure hole 181 while the second end 182*b* of the plate back pressure hole 182 may communicate with the back pressure chamber 160*a*. In this case, the plate back pressure hole 182 may be formed on the same axis as the axial direction of the rotational shaft 125 or may be inclined with respect to the axial direction of the rotational shaft 125. This embodiment illustrates an example in which the plate back pressure hole 182 is inclined at a preset or predetermined angle with respect to the axial direction of the rotational shaft 125. Accordingly, even if the first end 181*a* of the scroll back pressure hole 181 is formed on the same axis as the axial direction of the rotational shaft 125 in the state of being located adjacent to the discharge port 1511, namely, between the discharge port 1511 and the bypass hole 1512, the scroll back pressure hole 182 and the back pressure chamber 160*a* may communicate with each other through the plate back pressure hole 182.

For example, an intermediate discharge space portion 1611 through which the discharge port 1511 and the intermediate discharge port 1613 communicate with each other may be formed in a circular shape in or at a central portion of the back pressure plate 161, that is, a central portion of the fixed plate portion 161*a*, and the back pressure passage protrusion 1612 may protrude from the inner circumferential surface of the intermediate discharge pressure portion 1611 and extend in the axial direction.

The back pressure passage protrusion 1612 may have a cross-sectional area that is smaller than that of the intermediate discharge port 1613 when projected in the axial direction. In other words, as the back pressure passage protrusion 1612 protrudes from an inner circumferential surface of the intermediate discharge space portion 1611 toward the discharge port 1511, a portion of the intermediate discharge port 1613 may be obscured by the back pressure passage protrusion 1612 when projected in the axial direction. However, as the cross-sectional area of the back pressure passage protrusion 1612 is smaller than that of the intermediate discharge port 1613, refrigerant discharged through the discharge port 1511 may avoid the back pressure passage protrusion 1612 and smoothly flow to the intermediate discharge port 1613.

The first end 182*a* of the plate back pressure hole 182 may be formed through one side surface of the back pressure passage protrusion 1612, that is, one side surface of the back pressure passage protrusion 1612 facing the non-orbiting scroll 150, and the second end 182*b* of the plate back pressure hole 182 may be formed through an upper surface of the back pressure plate 161, that is, a bottom surface of the back pressure chamber 160*a* and/or an inner surface of the back pressure chamber 160*a*. Accordingly, even though the plate back pressure hole 182 is formed at an angle with respect to the axial direction of the rotational shaft 125, the length of the back pressure passage 180 including the scroll back pressure hole 181 and the plate back pressure hole 182 may be minimized, thereby reducing the dead volume in the back pressure passage 180.

In this way, as the scroll back pressure hole is formed through the non-orbiting wrap, when the orbiting scroll is tilted, the non-orbiting wrap of the non-orbiting scroll may be spaced apart from the orbiting end plate portion and the scroll back pressure hole may be opened. The compression chamber and the back pressure chamber may communicate with each other, and thus, pressure of the back pressure chamber may be quickly varied to be adaptive to pressure of the compression chamber. Accordingly, the pressure of the back pressure chamber, that is, back pressure, may be appropriately adjusted according to an operating mode and/or operating conditions, thereby increasing sealing power and suppressing excessive contact.

Hereinafter, description will be given of a back pressure passage according to another embodiment. That is, in the previous embodiment, the first back pressure passage portion forming the first end of the scroll oil supply passage is formed in the circular shape, but in some cases, the first back pressure passage portion may alternatively be formed in a long groove shape.

Figure 6:
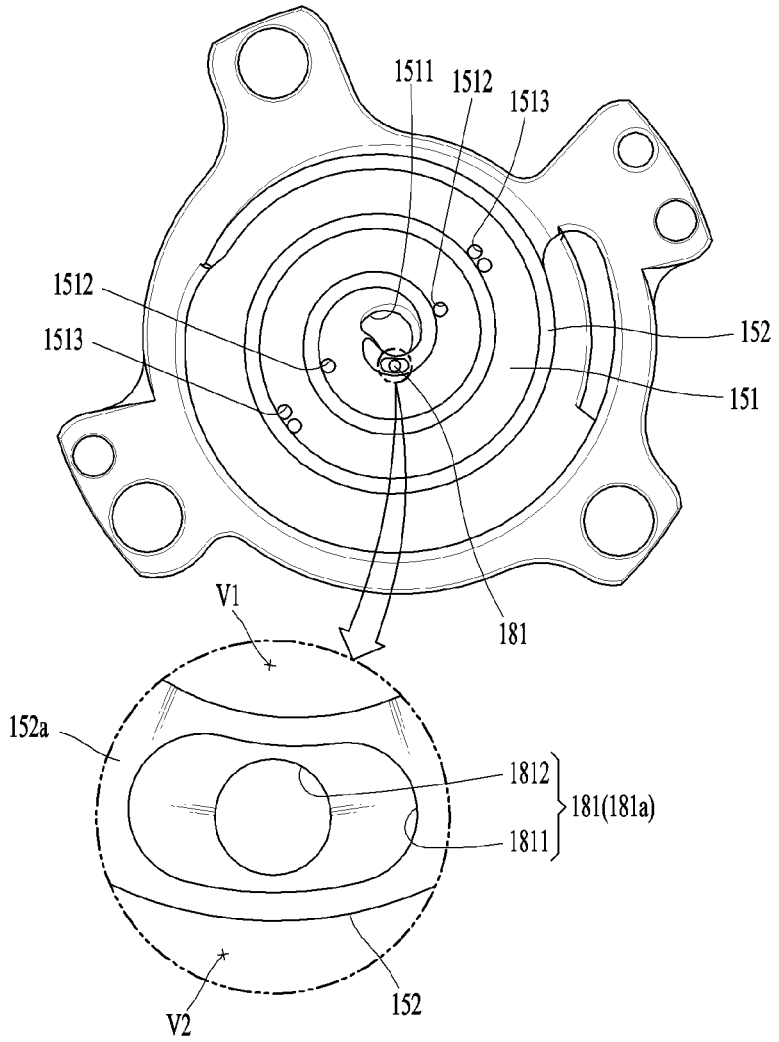
FIGS. 6 and 7 are bottom views of the non-orbiting scroll for explaining different embodiments of the back pressure passage in the scroll compressor according to FIG. 1.
Figure 7:
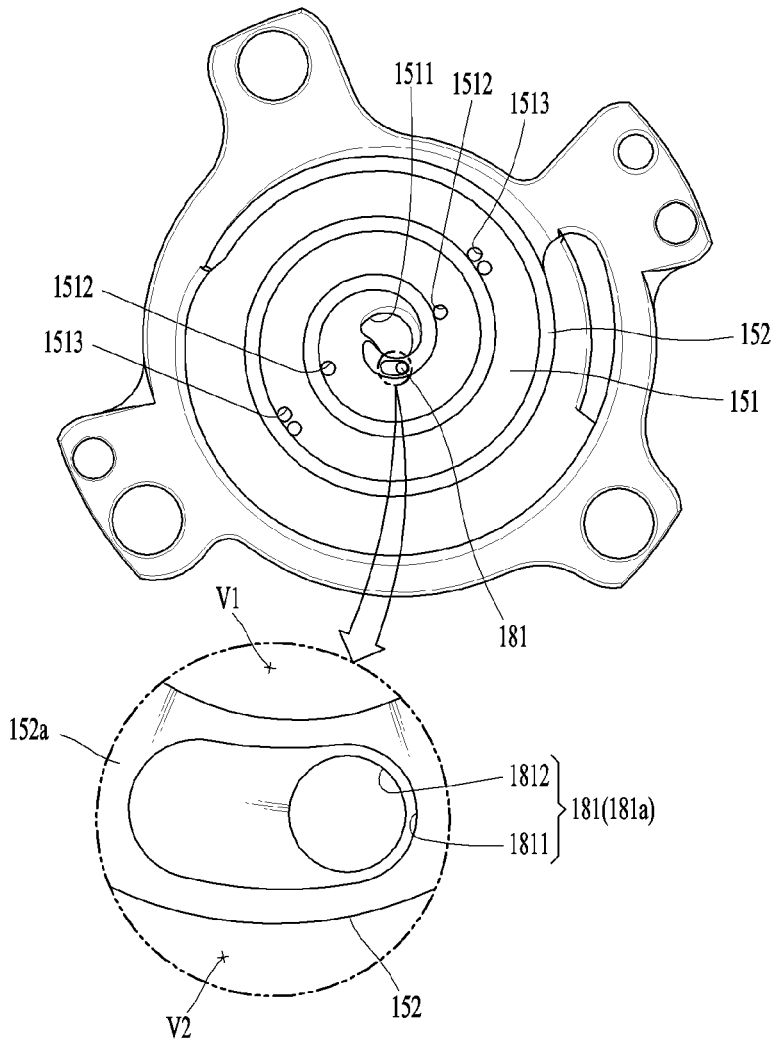

FIGS. 6 and 7 are bottom views of the non-orbiting scroll for explaining different embodiments of the back pressure passage in the scroll compressor according to FIG. 1.

Referring to FIGS. 6 and 7, the back pressure passage 180 according to this embodiment may include scroll back pressure hole 181 that communicates with the compression chamber V and plate back pressure hole 182 that communicates with the back pressure chamber 160*a*, and the scroll back pressure hole 181 may communicate with the compression chamber V through the front end surface 152*a* of the non-orbiting surface 152*a*. The basic configuration of the scroll back pressure hole 181 and the plate back pressure hole 182 and the operating effects thereof are almost the same as those of the previous embodiment, and thus, description thereof will be replaced with the description of the previous embodiment, and repetitive description has been omitted.

However, in this embodiment, the first back pressure passage portion 1811 forming the first end of the scroll back pressure hole 181 may be formed in the shape of a long groove that extends lengthwise along the formation direction of the non-orbiting wrap 152. In other words, the first back pressure passage portion 1811 may be formed such that a length thereof in the formation direction of the non-orbiting wrap 152 is longer than a length in the widthwise direction of the non-orbiting wrap 152. Accordingly, a cross-sectional area of the first back pressure passage portion 1811 may be expanded and simultaneously the front end surface 152*a* of the non-orbiting wrap 152 at an area where the first back pressure passage portion 1811 is formed may be maintained as thick as possible, resulting in improving reliability.

In this case, as illustrated in FIG. 6, the second back pressure passage portion 1812 may be located at a center of the first back pressure passage portion 1811, that is, at a center of the first back pressure passage portion 1811 on a major axis. Accordingly, a path length from both ends of the first back pressure passage portion 1811 to the back pressure chamber may be minimized, so that refrigerant may quickly move between the back pressure chamber 160*a* and the compression chamber V.

However, the second back pressure passage portion 1812 may alternatively be formed at a position eccentric with respect to the first back pressure passage portion 1811. For example, as illustrated in FIG. 7, the first back pressure passage portion 1811 may be formed in the shape of the long groove that extends lengthwise along the longitudinal direction, and the second back pressure passage portion 1812 may be formed to be biased to one side from the center of the first back pressure passage portion 1811.

In other words, the center of the second back pressure passage portion 1812 may be formed on a different line with respect to the center of the first back pressure passage portion 1811. In this embodiment, the second back pressure passage portion 1812 may be formed around an opposite end of the discharge port 1511 based on the center of the first back pressure passage portion 1811, to communicate with the first back pressure passage portion 1811. Accordingly, the first back pressure passage portion 1811 may be formed as close to the discharge port 1511 as possible while the second back pressure passage portion 1812 may be located far away from the discharge port 1511, such that the inclination of the plate back pressure hole 182 communicating with the second back pressure passage portion 1812 may be reduced or the plate back pressure hole 182 may be formed in the axial direction.

Hereinafter, description will be given of a back pressure passage according to still another embodiment. That is, in the previous embodiments, the back pressure passage through which the compression chamber and the back pressure chamber communicate with each other is formed to penetrate the non-orbiting wrap, but in some cases, a separate back pressure regulation passage may further be formed through the non-orbiting end plate portion, in addition to the back pressure passage.

Figure 8:
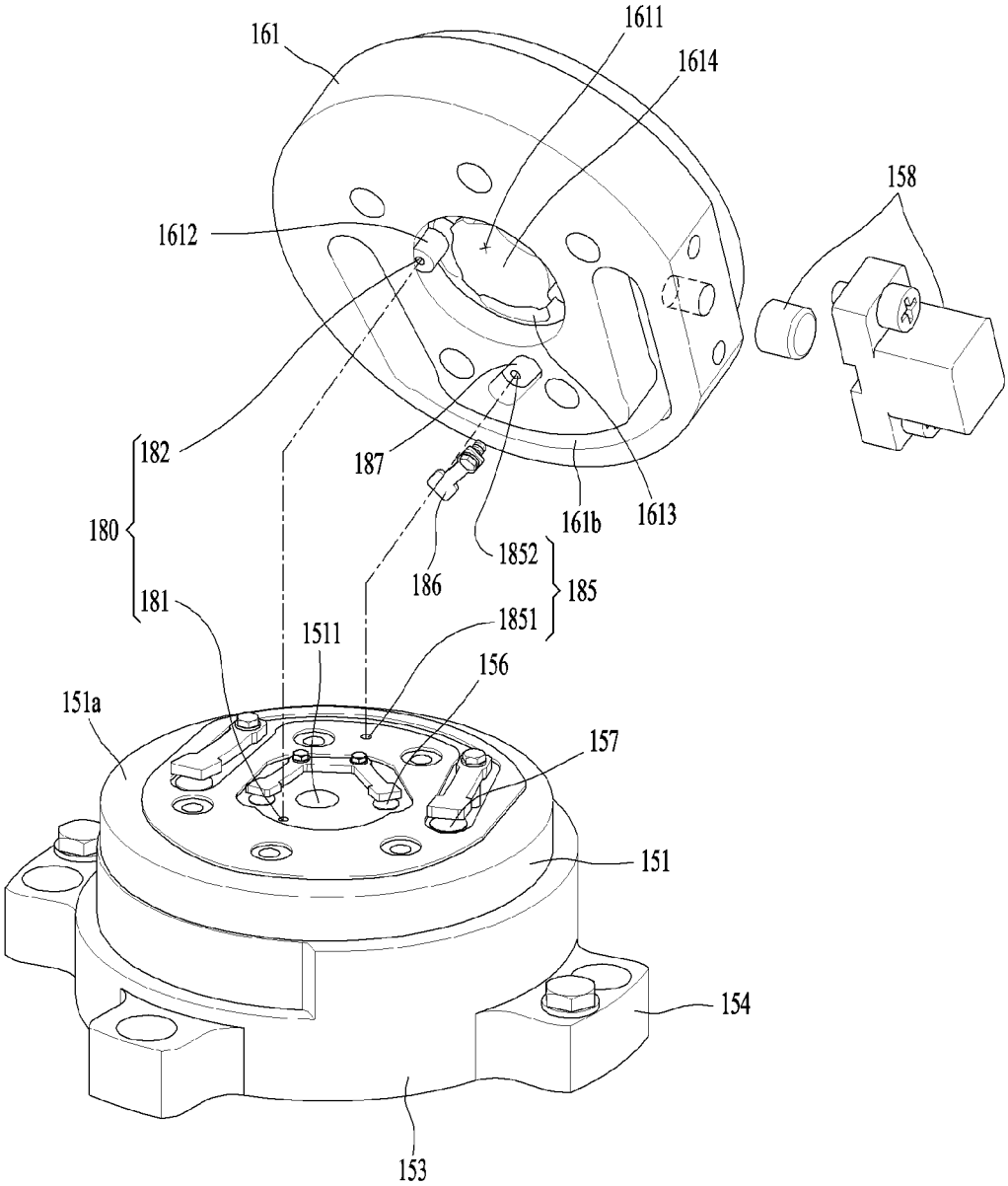
FIG. 8 is an exploded perspective view of a compression unit in the scroll compressor according to FIG. 1 according to another embodiment.
Figure 9:
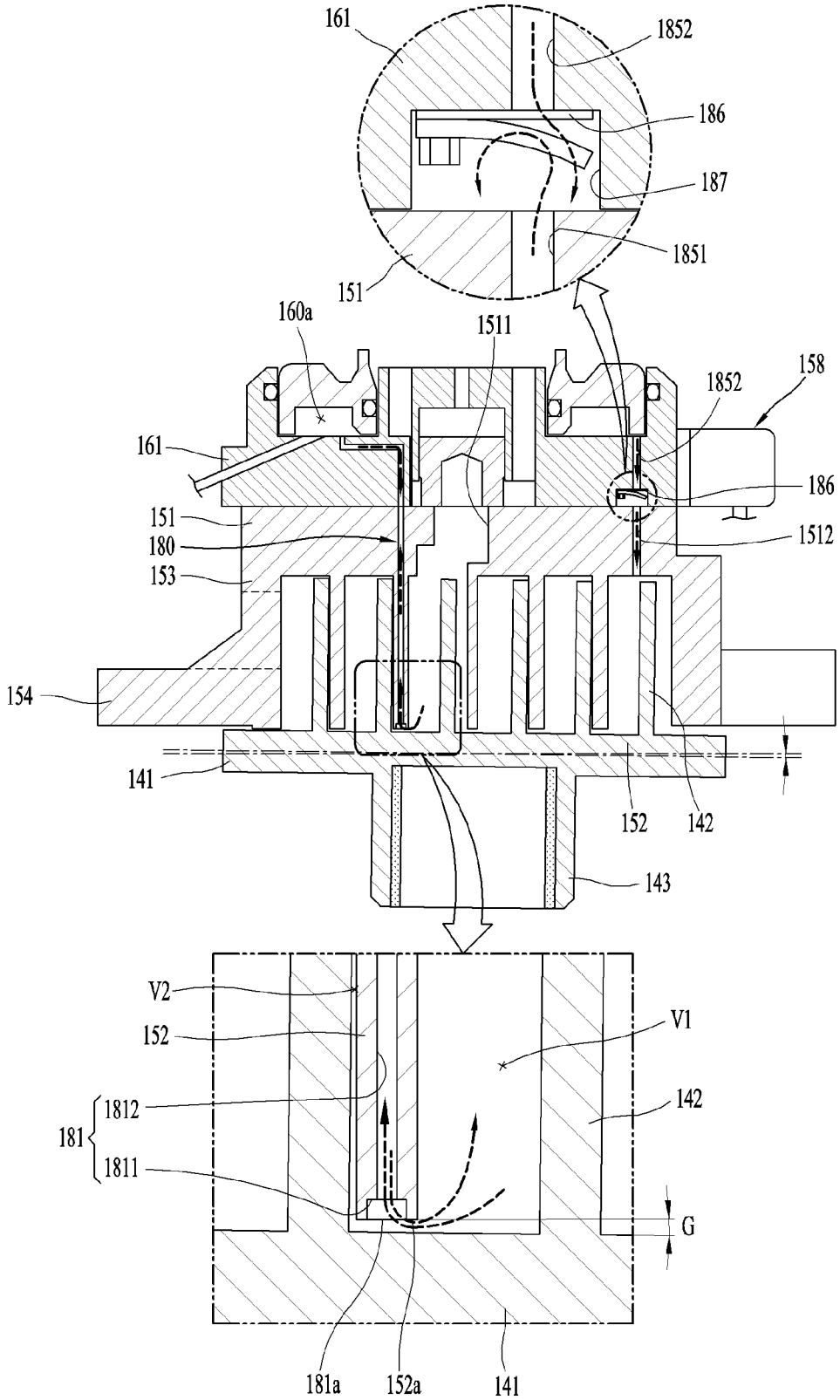
FIG. 9 is an assembled cross-sectional view of the compression unit of FIG. 8.

FIG. 8 is an exploded perspective view of a compression unit in the scroll compressor according to FIG. 1 according to another embodiment. FIG. 9 is an assembled cross-sectional view of the compression unit of FIG. 8.

Referring to FIGS. 8 and 9, the scroll compressor according to this embodiment may include back pressure passage 180 through which the compression chamber V and the back pressure chamber 160*a* communicate with each other, and another back pressure passage (hereinafter, defined as a back pressure regulation passage) 180 through which the compression chamber V and the back pressure chamber 160*a* communicate with each other. Accordingly, when pressure in the back pressure chamber 160*a* excessively increases, refrigerant in the back pressure chamber 160*a* may quickly leak into the compression chamber V having a suction pressure and/or a pressure similar to the suction pressure, thereby suppressing or preventing an excessive increase in pressure of the back pressure chamber 160*a* more effectively.

As the back pressure passage 180 is the same as the back pressure passages 180 in the previously described embodiments, description thereof will be replaced with the description of those embodiments and repetitive description has been omitted.

The back pressure regulation passage 185 may include a scroll back pressure regulation hole 1851 and a plate back pressure regulation hole 1852. The scroll back pressure regulation hole 1851 may be disposed in the non-orbiting scroll 150, and the plate back pressure control hole 1852 may be disposed in the back pressure chamber assembly 160 to communicate with the scroll back pressure control hole 1851.

More specifically, the scroll back pressure regulation hole 1851 may be formed through the non-orbiting end plate portion 151, and one end of the scroll back pressure regulation hole 1851 may penetrate the rear surface of the non-orbiting end plate portion 151 between the non-orbiting wraps 152 facing each other. Accordingly, the scroll back pressure regulation hole 1851 may directly communicate with the corresponding compression chamber V at a rotational angle at which it does not overlap the orbiting wrap 142 of the orbiting scroll 140 during the orbiting movement of the orbiting scroll 140.

The scroll back pressure regulation hole 1851 may be formed closer to a suction side than the scroll back pressure hole 181. For example, the scroll back pressure regulation hole 1851 may be located on the suction side compared to the bypass hole 1512 and/or the variable capacity hole 1513. Accordingly, the plate back pressure regulation hole 1852 may be located on the same axis as the scroll back pressure hole 181.

In addition, as the scroll back pressure regulation hole 1851 is located on the suction side compared to the bypass hole 1512 and/or the variable capacity hole 1513, a pressure difference between the compression chamber V communicating with the scroll back pressure regulation hole 1851 and the back pressure chamber 160*a* may be increased, such that refrigerant in the back pressure chamber 160*a* may quickly flow toward the compression chamber V, thereby maintaining appropriate back pressure in the back pressure chamber 160*a*. In this case, even if the back pressure regulation passage 185 is not provided with a separate valve, the back pressure regulation passage 185 may be periodically opened and closed by the orbiting wrap 142 during the orbiting movement of the orbiting scroll 140, thereby suppressing or preventing pulsation of the back pressure chamber 160*a* appropriately.

However, in some cases, a back pressure regulation valve 186 may be disposed in or at a middle portion of the back pressure regulation passage 185. This embodiment illustrate an example provided with the back pressure regulation valve 186 that allows refrigerant movement from the back pressure chamber 160*a* to the compression chamber V while restricting refrigerant movement in a reverse direction.

For example, a valve receiving groove 187 in which the back pressure regulation valve 186 is received may be formed in the rear surface of the back pressure plate 161 facing the non-orbiting scroll 150. One end of the plate back pressure regulation hole 1842 may be formed through the valve receiving groove 187 to be opened and closed by the back pressure regulation valve 186. Accordingly, only when the pressure in the back pressure chamber 160*a* is higher than a predetermined pressure, refrigerant in the back pressure chamber 160*a* may flow into the compression chamber V through the back pressure regulation passage 185, thereby lowering the pulsation in the back pressure chamber 160.

In the foregoing embodiments, descriptions were given focusing on the example in which the first variable-capacity valve 1813 and the second variable-capacity valve 1823 were configured as reed valves, but these variable-capacity valves 1813 and 1823 may alternatively be piston valves other than the reed valves. In addition, in the foregoing embodiments, a low-pressure scroll compressor has been described as an example, but embodiments may equally be applied to any hermetic compressor in which the inner space of the casing 110 is divided into the low-pressure portion 110*a* as the suction space and the high-pressure portion as the discharge space.

In addition, in the previous embodiments, the structure in which the back pressure chamber assembly 160 including the back pressure plate 161 and the floating plate 165 is separately fastened to the rear surface of the non-orbiting scroll 150 has been described, but in some cases, the embodiments may be applied equally even to a case in which the back pressure plate 161 is excluded and a first annular wall portion 161*b* and a second annular wall portion 161*c* extend as a single body from the rear surface of the non-orbiting scroll 150.

Embodiments disclosed herein provide a scroll compressor that is capable of suppressing or preventing overcompression while reducing mechanical friction loss between an orbiting scroll and a non-orbiting scroll in a fixed back pressure type.

Embodiments disclosed herein also provide a scroll compressor that is capable of varying back pressure quickly and appropriately depending on an operating mode.

Further, embodiments disclosed herein further provide a scroll compressor that is capable of quickly varying back pressure by allowing a back pressure passage to be consecutively open depending on an operating mode.

Embodiments disclosed herein provide a scroll compressor that may include a casing, an orbiting scroll, a non-orbiting scroll, a back pressure chamber assembly, and a back pressure passage. The casing may have a hermetic inner space, which may be divided into a low-pressure part or portion and a high-pressure part or portion. The orbiting scroll may be coupled to a rotational shaft in an inner space of the casing to perform an orbiting motion, and have an orbiting wrap on one side surface of an orbiting end plate portion thereof. The non-orbiting scroll may have a non-orbiting wrap formed on one side surface of a non-orbiting end plate portion thereof facing the orbiting end plate portion and engaged with the orbiting wrap to form a compression chamber. The back pressure chamber assembly may be disposed on a rear surface of the non-orbiting scroll to form a back pressure chamber. The back pressure passage may provide communication between the compression chamber and the back pressure chamber to guide a portion of refrigerant compressed in the compression chamber to the back pressure chamber. The back pressure passage may communicate with the compression chamber through a front end surface of the non-orbiting wrap facing the orbiting end plate portion in an axial direction. Accordingly, when an orbiting scroll tilts, the non-orbiting wrap of the non-orbiting scroll may be spaced apart from the orbiting end plate portion to open a scroll back pressure hole, such that the compression chamber and the back pressure chamber communicate with each other to quickly vary pressure in the back pressure chamber to be adaptive to a pressure of the compression chamber. Accordingly, the pressure of the back pressure chamber 160*a*, that is, the back pressure, may be appropriately adjusted according to an operating mode and/or operating conditions, thereby increasing sealing power and suppressing excessive contact.

For example, the back pressure passage may be formed within a range of 360° along a formation direction of the non-orbiting wrap, starting from a discharge end of the non-orbiting wrap. Accordingly, a pressure difference between both ends of the back pressure passage may be generated as large as possible, and thus, refrigerant may smoothly flow between the compression chamber and the back pressure chamber.

The non-orbiting scroll may include a suction port formed in an outer circumferential side thereof such that the compression chamber communicates with the low-pressure portion, a discharge port formed in or at a central portion of the non-orbiting scroll such that the compression chamber communicates with the high-pressure portion, and a bypass hole formed between the suction port and the discharge port such that the compression chamber communicates with the high-pressure portion. The back pressure passage may be located between the discharge port and the bypass hole. With this structure, the back pressure passage may be located as close to the discharge port as possible so that a great pressure difference may be generated between both ends of the back pressure passage.

The back pressure passage may include a scroll back pressure hole formed through the non-orbiting scroll, and a plate back pressure hole that communicates with the scroll back pressure hole and penetrates the back pressure chamber assembly. The scroll back pressure hole and the plate back pressure hole may be formed on a same axis. This may minimize an overall length of the plate back pressure hole to thus reduce a dead volume due to the plate back pressure hole.

A back pressure passage protrusion may extend from at least one of the non-orbiting scroll or the back pressure chamber assembly. At least a portion of the plate back pressure hole or the scroll back pressure hole may be formed inside of the back pressure passage protrusion. As the plate back pressure hole is located to overlap an intermediate discharge port when projected in an axial direction, the back pressure hole may be formed as adjacent to the discharge port as possible.

More specifically, a discharge port may be formed in the non-orbiting scroll, and an intermediate discharge port to provide communication between the discharge port and the high-pressure part may be formed in the back pressure chamber assembly. An intermediate discharge space portion may be formed between the discharge port and the intermediate discharge port to provide communication between the discharge port and the intermediate discharge port. The back pressure passage protrusion may protrude from an inner circumferential surface of the intermediate discharge space portion to have a smaller cross-sectional area than that of the intermediate discharge port. With this structure, the plate back pressure hole may be formed at a position to overlap the intermediate discharge port when projected in the axial direction, while minimizing flow resistance of refrigerant discharged through the intermediate discharge port.

The back pressure passage may include a first back pressure passage portion formed to be recessed by a preset or predetermined depth in a front end surface of the non-orbiting wrap, and a second back pressure passage portion that communicates with the first back pressure passage portion and extends from inside of the non-orbiting wrap toward the back pressure chamber assembly. A cross-sectional area of the first back pressure passage portion may be larger than a cross-sectional area of the second back pressure passage portion. With this structure, a volume of the first back pressure passage portion adjacent to the compression chamber may increase, forming a type of differential pressure space between the compression chamber and the back pressure chamber, thereby promoting refrigerant movement.

The first back pressure passage portion and the second back pressure passage portion may be formed on a same axis. This may facilitate formation of the first back pressure passage portion and the second back pressure passage portion.

More specifically, the first back pressure passage portion may be formed in a shape of a long groove that extends lengthwise along a formation direction of the non-orbiting wrap. The second back pressure passage portion may communicate with the first back pressure passage portion at a center of the first back pressure passage portion in a major axial direction. This may expand a cross-sectional area of the first back pressure passage portion while maintaining a front end surface of the non-orbiting wrap as thick as possible in an area where the first back pressure passage portion is formed, thereby improving reliability.

Also, the first back pressure passage portion and the second back pressure passage portion may be formed on different axes. With this structure, the first back pressure passage portion may be formed as close to the discharge port as possible while the second back pressure passage portion may be located far away from the discharge port.

Also, the first back pressure passage portion may be formed in a shape of a long groove that extends lengthwise along a formation direction of the non-orbiting wrap. The second back pressure passage portion may communicate with the first back pressure passage portion at a side far from a discharge port disposed in the non-orbiting scroll based on a center of the first back pressure passage portion in a major axial direction. With this structure, the first back pressure passage portion may be formed as close to the discharge port as possible while the second back pressure passage portion may be located far away from the discharge port, such that the inclination of the plate back pressure hole communicating with the second back pressure passage portion may be reduced or the plate back pressure hole may be formed in the axial direction.

The non-orbiting scroll may include a suction port formed in an outer circumferential side thereof such that the compression chamber communicates with the low-pressure part, a discharge port formed in a central portion of the non-orbiting scroll such that the compression chamber communicates with the high-pressure part, and a bypass hole formed between the suction port and the discharge port such that the compression chamber communicates with the high-pressure part. The first back pressure passage portion may be defined to be located between the discharge port and the bypass hole. With this structure, the back pressure passage may be located as close to the discharge port as possible so that a great pressure difference may be generated between both ends of the back pressure passage.

According to another embodiment, the scroll compressor may further include a back pressure regulation passage that provides communication between the compression chamber and the back pressure chamber to guide refrigerant in the back pressure chamber to the compression chamber. The back pressure regulation passage may be disposed on a suction side compared to the back pressure passage. With this structure, when the pressure in the back pressure chamber rises excessively, refrigerant in the back pressure chamber may quickly leak into the compression chamber, making it possible to suppress or prevent excessive increase in the pressure of the back pressure chamber more effectively.

For example, the back pressure regulation passage may communicate with the compression chamber through the non-orbiting end plate portion between the non-orbiting wraps. With this structure, the back pressure regulation passage may be periodically opened and closed according to the orbiting movement of the orbiting scroll, such that the compression chamber and the back pressure chamber may periodically communicate with each other.

More specifically, the back pressure regulation passage may have a back pressure regulation valve that allows movement of refrigerant from the back pressure chamber to the compression chamber while restricting movement of refrigerant from the compression chamber to the back pressure chamber. This may allow refrigerant in the back pressure chamber to flow toward the compression chamber through the back pressure regulation passage only when pressure in the back pressure chamber is higher than predetermined pressure, thereby lowering the pulsation in the back pressure chamber.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a hermetic inner space divided into a low-pressure portion and a high-pressure portion;

an orbiting scroll coupled to a rotational shaft in the inner space of the casing to perform an orbiting motion, and having an orbiting wrap on one side surface of an orbiting end plate thereof;

a non-orbiting scroll having a non-orbiting wrap formed on one side surface of a non-orbiting end plate thereof that faces the orbiting end plate and engaged with the orbiting wrap to form a compression chamber;

a back pressure chamber assembly disposed on a rear surface of the non-orbiting scroll to form a back pressure chamber; and a back pressure passage that provides communication between the compression chamber and the back pressure chamber to guide a portion of refrigerant compressed in the compression chamber to the back pressure chamber, wherein the back pressure passage opens at a front end surface of the non-orbiting wrap facing the orbiting end plate in an axial direction to communicate with the compression chamber, wherein the back pressure passage comprises a scroll back pressure hole formed through the non-orbiting scroll and a plate back pressure hole that communicates with the scroll back pressure hole and penetrates the back pressure chamber assembly, wherein a discharge port is formed in the non-orbiting scroll, and an intermediate discharge port that provides communication between the discharge port and the high-pressure portion is formed in the back pressure chamber assembly, wherein an intermediate discharge space portion is formed between the discharge port and the intermediate discharge port that provides communication between the discharge port and the intermediate discharge port, wherein a back pressure passage protrusion extends from at least one of the non-orbiting scroll or the back pressure chamber assembly, wherein at least a portion of the plate back pressure hole or the scroll back pressure hole is formed inside of the back pressure passage protrusion, and wherein the back pressure passage protrusion protrudes from an inner circumferential surface of the intermediate discharge space portion to have a smaller cross-sectional area than a cross-sectional area of the intermediate discharge port.

2. The scroll compressor of claim 1, wherein the back pressure passage is formed within a range of 360° along a formation direction of the non-orbiting wrap, starting from a discharge end of the non-orbiting wrap.

3. The scroll compressor of claim 2, wherein the non-orbiting scroll includes a suction port formed in an outer circumferential side thereof such that the compression chamber communicates with the low-pressure portion, wherein the discharge port is formed in a central portion of the non-orbiting scroll such that the compression chamber communicates with the high-pressure portion, wherein at least one bypass hole is formed between the suction port and the discharge port such that the compression chamber communicates with the high-pressure portion, and wherein the back pressure passage is located between the discharge port and the at least one bypass hole.

4. The scroll compressor of claim 1, wherein the scroll back pressure hole and the plate back pressure hole are formed on a same axis.

5. The scroll compressor of claim 1, wherein the scroll back pressure hole comprises:

a first back pressure passage recessed by a predetermined depth into a front end surface of the non-orbiting wrap; and a second back pressure passage portion that communicates with the first back pressure passage and extends from an inside of the non-orbiting wrap toward the back pressure chamber assembly, and wherein a cross-sectional area of the first back pressure passage is larger than a cross-sectional area of the second back pressure passage.

6. The scroll compressor of claim 5, wherein the first back pressure passage and the second back pressure passage are formed on a same axis.

7. The scroll compressor of claim 6, wherein the first back pressure passage is formed in a shape of a groove that extends lengthwise along a formation direction of the non-orbiting wrap, and wherein the second back pressure passage communicates with the first back pressure passage portion at a center of the first back pressure passage in a major axial direction.

8. The scroll compressor of claim 5, wherein the first back pressure passage and the second back pressure passage are formed on different axes.

9. The scroll compressor of claim 8, wherein the first back pressure passage is formed in a shape of a groove that extends lengthwise along a formation direction of the non-orbiting wrap, and wherein the second back pressure passage communicates with the first back pressure passage at a side farther from the discharge port disposed in the non-orbiting scroll based on a center of the first back pressure passage in a major axial direction.

10. The scroll compressor of claim 5, wherein the non-orbiting scroll includes a suction port formed in an outer circumferential side thereof such that the compression chamber communicates with the low-pressure portion, wherein the discharge port is formed in a central portion of the non-orbiting scroll such that the compression chamber communicates with the high-pressure portion, wherein at least one bypass hole is formed between the suction port and the discharge port such that the compression chamber communicates with the high-pressure portion, and wherein the first back pressure passage is located between the discharge port and the at least one bypass hole.

11. The scroll compressor of claim 1, further comprising a back pressure regulation passage that provides communication between the compression chamber and the back pressure chamber to guide refrigerant in the back pressure chamber to the compression chamber, wherein the back pressure regulation passage is disposed on a suction side compared to the back pressure passage.

12. The scroll compressor of claim 11, wherein the back pressure regulation passage communicates with the compression chamber through the non-orbiting end plate.

13. The scroll compressor of claim 12, wherein the back pressure regulation passage includes a back pressure regulation valve that allows movement of refrigerant from the back pressure chamber to the compression chamber while restricting movement of refrigerant from the compression chamber to the back pressure chamber.

14. A scroll compressor, comprising:

a casing having a hermetic inner space divided into a low-pressure portion and a high-pressure portion;

an orbiting scroll coupled to a rotational shaft in the inner space of the casing to perform an orbiting motion, and having an orbiting wrap on one side surface of an orbiting end plate thereof;

a non-orbiting scroll having a non-orbiting wrap formed on one side surface of a non-orbiting end plate thereof facing the orbiting end plate and engaged with the orbiting wrap to form a compression chamber;

a back pressure chamber assembly disposed on a rear surface of the non-orbiting scroll to form a back pressure chamber; and a back pressure passage that provides communication between the compression chamber and the back pressure chamber to guide a portion of refrigerant compressed in the compression chamber to the back pressure chamber, wherein the back pressure passage comprises:

a first back pressure passage recessed by a predetermined depth in a front end surface of the non-orbiting wrap; and a second back pressure passage that communicates with the first back pressure passage and extends from inside of the non-orbiting wrap toward the back pressure chamber assembly, and wherein a cross-sectional area of the first back pressure passage is larger than a cross-sectional area of the second back pressure passage.

15. The scroll compressor of claim 14, wherein the first back pressure passage and the second back pressure passage are formed on a same axis.

16. The scroll compressor of claim 14, wherein the first back pressure passage and the second back pressure passage are formed on different axes.

17. The scroll compressor of claim 14, wherein the non-orbiting scroll includes a suction port formed in an outer circumferential side thereof such that the compression chamber communicates with the low-pressure portion, a discharge port formed in a central portion of the non-orbiting scroll such that the compression chamber communicates with the high-pressure portion, and at least one bypass hole formed between the suction port and the discharge port such that the compression chamber communicates with the high-pressure portion, and wherein the first back pressure passage is located between the discharge port and the at least one bypass hole.

18. The scroll compressor of claim 14, wherein the back pressure passage is formed within a range of 360° along a formation direction of the non-orbiting wrap, starting from a discharge end of the non-orbiting wrap.

19. A scroll compressor, comprising:

a casing having a hermetic inner space divided into a low-pressure portion and a high-pressure portion;

an orbiting scroll coupled to a rotational shaft in the inner space of the casing to perform an orbiting motion, and having an orbiting wrap on one side surface of an orbiting end plate thereof;

a non-orbiting scroll having a non-orbiting wrap formed on one side surface of a non-orbiting end plate thereof that faces the orbiting end plate and engaged with the orbiting wrap to form a compression chamber;

a back pressure chamber assembly disposed on a rear surface of the non-orbiting scroll to form a back pressure chamber;

a back pressure passage that provides communication between the compression chamber and the back pressure chamber to guide a portion of refrigerant compressed in the compression chamber to the back pressure chamber, wherein the back pressure passage is formed within a back pressure passage protrusion that extends radially inward from at least one of the non-orbiting scroll or the back pressure chamber assembly; and a back pressure regulation passage that provides communication between the compression chamber and the back pressure chamber to guide refrigerant in the back pressure chamber to the compression chamber, wherein the back pressure regulation passage is disposed on a suction side compared to the back pressure passage.

20. The scroll compressor of claim 19, wherein the back pressure passage is formed within a range of 360° along a formation direction of the non-orbiting wrap, starting from a discharge end of the non-orbiting wrap wherein the back pressure passage is formed at a discharge end of the non-orbiting wrap.

* * * * *